US005441856A

United States Patent [19]

Merkel et al.

[11] Patent Number: 5,441,856

[45] Date of Patent: Aug. 15, 1995

[54] PHOTOGRAPHIC ELEMENTS CONTAINING INDOANILINE DUMMY DYES

[75] Inventors: Paul B. Merkel; David Hoke, both of Rochester, N.Y.

[73] Assignee: Eastman Kodak Company, Rochester, N.Y.

[21] Appl. No.: 169,089

[22] Filed: Dec. 17, 1993

[51] Int. Cl.[6] ..... G03C 1/46

[52] U.S. Cl. ..... 430/504; 430/507; 430/510; 430/517; 430/522; 430/559

[58] Field of Search ..... 430/504, 507, 510, 517, 430/522, 559

[56] References Cited

U.S. PATENT DOCUMENTS

| | | | |
|---|---|---|---|
| 2,322,027 | 6/1943 | Jelley et al. | 95/7 |
| 3,547,640 | 12/1970 | Beckett et al. | 96/74 |
| 4,647,527 | 3/1987 | Ikenoue et al. | 430/505 |
| 4,746,600 | 5/1988 | Watanabe et al. | 430/505 |
| 4,775,616 | 10/1988 | Kilminster et al. | 430/552 |
| 4,849,328 | 7/1989 | Hoke et al. | 430/553 |
| 4,923,791 | 5/1990 | Merkel et al. | 430/553 |
| 5,045,442 | 9/1991 | Hoke | 430/553 |
| 5,075,205 | 12/1991 | Inagaki et al. | 430/510 |
| 5,108,883 | 4/1992 | Matejec et al. | 430/522 |

FOREIGN PATENT DOCUMENTS

| | | |
|---|---|---|
| 7335376 | 8/1969 | Japan . |
| 62168153 | 1/1986 | Japan . |
| 01144048 | 11/1987 | Japan . |
| 01265251 | 4/1988 | Japan . |
| 01265252 | 4/1988 | Japan . |
| 02100044 | 10/1988 | Japan . |
| 03142287 | 10/1989 | Japan . |
| 03142443 | 10/1989 | Japan . |
| 03192348 | 12/1989 | Japan . |

*Primary Examiner*—Charles L. Bowers, Jr.
*Assistant Examiner*—Geraldine Letscher
*Attorney, Agent, or Firm*—Gordon M. Stewart

[57] ABSTRACT

A photographic element, and a method of making such an element, comprising a cyan dummy dye present in the element prior to exposure and development. The particular cyan dummy dye has a high extinction coefficient, low density losses in seasoned bleach, while maintaining the desired hue and resisting density losses on cold storage. The dye has the formula:

wherein:

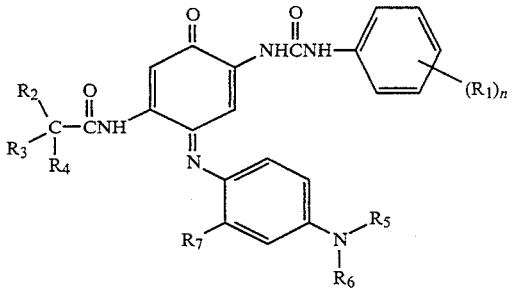

I n is 1, 2 or 3;

each $R_1$ is an electron-withdrawing group which may be the same or different when n is 2 or 3;

$R_2$ is an alkyl group having from one to about 20 carbon atoms, a cycloalkyl group having from 3 to 8 carbon atoms in the ring, or an aryl group;

$R_3$ is any of the groups which $R_2$ may be or is hydrogen;

$R_4$ is selected from the group consisting of alkylsulfonyl, arylsulfonyl, alkylsulfoxyl, arylsulfoxyl, sulfamoyl, alkylsulfonate, carbamoyl, alkoxycarbonyl and acyl groups;

$R_5$ is an alkyl group;

$R_6$ is hydrogen, or an alkyl group; and $R_7$ is hydrogen or an alkyl group.

20 Claims, No Drawings

PHOTOGRAPHIC ELEMENTS CONTAINING INDOANILINE DUMMY DYES

FIELD OF THE INVENTION

This invention relates to photographic elements containing specific indoaniline cyan dummy dyes of a type which have a high extinction coefficient along with other desirable properties.

BACKGROUND OF THE INVENTION

Modern color negative films usually contain dyes coated in one or more layers for a variety of purposes. In addition to being utilized for spectral sensitization, dyes may be used for filtering specific wavelengths of exposing light (either as intergrain absorbers or in separate layers containing no silver halide), for antihalation and to adjust the background density (Dmin) of color negative films for printing purposes. Such preformed coated dyes (that is, dyes which are present in the element prior to exposure and development) are often referred to as "dummy dyes" to distinguish them from dyes that may be formed photographically (typically from coupler compounds) as a result of exposure and chromogenic development.

In the development of color photographic elements, bleach solutions are used to oxidize developed silver to silver ions for subsequent removal in fix solution by formation of soluble silver complexes. The bleach and fix solutions are sometimes combined into a single "blix" solution. Bleach solutions commonly contain complexes of ferric ion, such as ferric ethylenediaminetetraacetic acid (EDTA), as oxidizing agents. Prolonged use of such solutions for processing of photographic film can result in accumulation of substantial quantities of the corresponding ferrous ion complexes (such as ferrous EDTA), which can function as reducing agents. These reducing agents can cause reductive discoloration of dummy dyes (so called leuco dye formation). The formation of leuco dye in such seasoned bleaches is undesirable, not only because the resulting Dmin density provided by the dummy dye will be less than the optimum required for proper printing characteristics, but also because variabilities in Dmin can occur as seasoning of a bleach progresses.

Many cyan dummy dyes that have been used in color negative films for antihalation and for Dmin adjustment have suffered from a number of deficiencies, including loss of color in seasoned photographic bleach solutions or in bleaches of low oxidizing strength. Additionally, they may also have improper hue or suffer from changes in hue and/or density upon storage at low or high temperatures. For example, the dye of structure C1 has been used extensively in a number of commercial color negative films. The hue of this dye is suitable for Dmin adjustment and for antihalation purposes. However, dye C1 can undergo reductive discoloration when films containing it are processed in seasoned photographic bleaches or in bleaches of weak oxidizing power.

C1

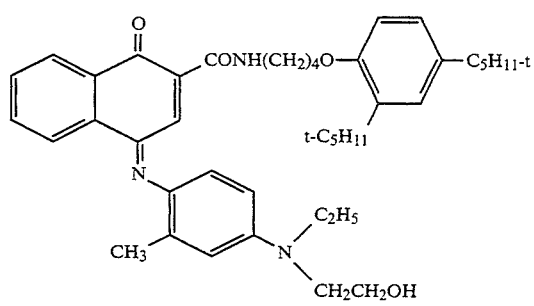

The dye of structure C2 dissolved in the high-boiling solvent N,N-diethyldodecanamide has also been used as a dummy dye in commercial color negative film. However, as illustrated in Examples below, this composition yields a dye hue that is too hypsochromic, and the extinction coefficient of dye C2 is also undesirably low. Due to the hypsochromic (shorter wavelength) absorption of a film containing dye C2 as a dummy dye in N,N-diethyldodecanamide relative to films containing dye C1, the printing characteristics of the two types of film can be sufficiently different to yield objectionable color balance differences when the two types of film are printed together using automatic high- speed printers. The N,N-diethyldodecanamide was used previously to facilitate dissolution of dye C2. U.S. Pat. No. 5,108,883 discloses the use of dye C2 dissolved in dibutyl phtahalate. While the hue of such a composition would be less hypsochromic and more suitable for proper printing, this composition also results in a low dye extinction coefficient and thus requires that more dye be coated to achieve the desired red density.

C2

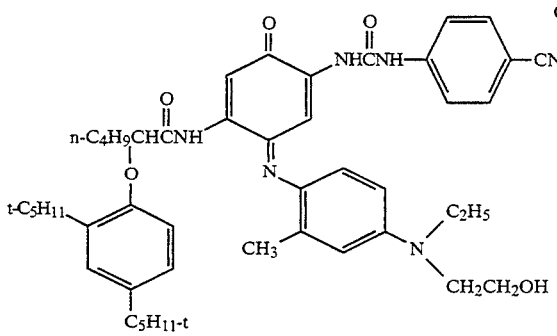

Thus, there has been a need to find replacements for such dummy dyes, particularly cyan dummy dyes, which replacements would exhibit high extinction coefficients to provide good cyan density with less dye, and low tendency to undergo leuco dye formation in seasoned bleaches or weak bleaches while retaining the desired spectral properties of dummy dyes such as dye C-1.

SUMMARY OF THE INVENTION

The present invention therefore provides a photographic element, and a method of making such a photographic element, which element comprises a cyan dummy dye present in the element prior to exposure and development, the dye having the formula:

I

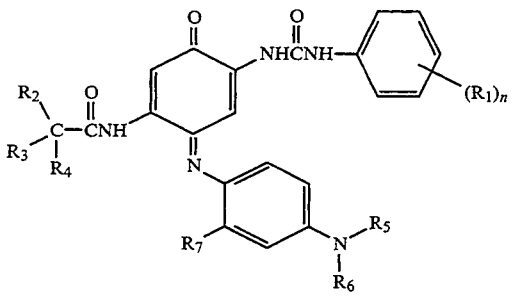

wherein:

n is 1, 2 or 3;

each $R_1$ is an electron-withdrawing group which may be the same or different when n is 2 or 3;

$R_2$ is an alkyl group having from one to about 20 carbon atoms, a cycloalkyl group having from 3 to 8 carbon atoms in the ring, or an aryl group;

$R_3$ is any of the groups which $R_2$ may be or is hydrogen;

$R_4$ is selected from the group consisting of alkylsulfonyl, arylsulfonyl, alkylsulfoxyl, arylsulfoxyl, sulfamoyl, alkylsulfonate, carbamoyl, alkoxycarbonyl and acyl groups;

$R_5$ is an alkyl group;

$R_6$ is hydrogen, or an alkyl group, and $R_7$ is hydrogen or an alkyl group.

EMBODIMENTS OF THE INVENTION

As described above, $R_1$ in the above formula I is an electron withdrawing group. Electron withdrawing groups are discussed in March, *Advanced Organic Chemistry*, pages 20–21, 228–229, 386–387, 494–497. In particular, preferred electron withdrawing substituents would have a Hammett $\sigma p$ constant of greater than 0.1 and preferably between 0.1 and 1.0 (for example, between any of 0.3, 0.4, 0.5 or 0.6 and 1.0). Hammett $\sigma p$ values are discussed in *Advanced Organic Chemistry* 3rd Ed., J. March, (John Wiley Sons, NY; 1985). Note that the "p" subscript refers to the fact that the $\sigma$ values are measured with the substituents in the para position of a benzene ring. Additional tables relating to Hammett $\sigma p$ constants can be found in *Chemical Reviews* Volume 91, pages 165–195 (authored by C Hansch et al.). Examples of electron-withdrawing groups include nitro, cyano, sulfamoyl, sulfonamido, alkylsulfonyl, arylsulfonyl, carbamoyl, carbonamido, alkoxycarbonyl, aryloxycarbonyl and trifluoromethyl groups and halogen atoms, such as chlorine and fluorine.

$R_2$ may particularly include substituted or unsubstituted alkyl of from 1 to 10 carbon atoms (for example, methyl, ethyl, propyl, butyl). Similarly, when $R_3$ is not H, it may also particularly include one of the foregoing substituted types of alkyl. In any event though, it is preferred that $R_2$, $R_3$ and $R_4$ together have at least 10 carbon atoms (including at least 15, at least 17, or at least 20 carbon atoms). With the foregoing total being at least 10 carbon atoms, water solubility and wandering of the cyan dummy dye of formula I is reduced.

It is particularly preferred that the cyan dummy dye of formula I have $R_4$ as a substituted or unsubstituted alkylsulfonyl. Examples include a substituted or unsubstituted alkylsulfonyl with at least 10, at least 14, at least 16, or at least 20 carbon atoms. $R_7$ may have any number of carbon atoms, particularly including 1 to 10 carbon atoms (such as a substituted ethyl, propyl, butyl, pentyl, hexyl, and the like). As to $R_5$ and $R_6$, as already mentioned either may be an alkyl group (such as a substituted or unsubstituted methyl, ethyl, propyl, pentyl, butyl or other 1 to 8 carbon atom alkyl). However, it is preferred that $R_5$ is ethyl, and $R_6$ is ethyl, beta-hydroxyethyl or beta-(methylsulfonamido)ethyl and $R_7$ is methyl, since then the dummy dye may be synthesized from commonly used developing agents.

Substituents which may be used on any of the groups of $R_1$, $R_2$, $R_3$, $R_4$, $R_5$ or $R_6$ and $R_7$ include include any known substituents, such as halogen (for example, chloro, fluoro, bromo, iodo), alkoxy (for example, methoxy, ethoxy), substituted or unsubstituted alkyl (for example, methyl, trifluoromethyl), alkenyl, alkylthio (for example, methylthio or ethylthio), substituted and unsubstituted aryl (for example, phenyl) heterocyclic structures (for example, thienyl, furyl, pyrrolyl), and others known in the art. Such alkoxy and substituted alkyl may specifically include "lower" alkyl and alkoxy, that is having from 1 to 6 carbon atoms, for example, methyl, ethyl, and the like. Additionally, substituents may form bridged linkages. Further, with regard to any alkyl group, alkylene group or alkenyl group, it will be understood that these can be branched or unbranched and include ring structures.

The photographic elements of this invention can have the indoaniline cyan dummy dyes of the type described above, incorporated in them by first dispersing an oil phase containing the dye in an aqueous phase containing a binder, such as gelatin, and one or more surfactants. The dye-containing dispersion is then coated in the appropriate layer of a multilayer film on a suitable support. The oil phase (that is, the water immiscible solvent phase) usually consists of the dye dissolved in one or more high-boiling solvents (the boiling point being typically higher than 200° C.). This is typically added to an aqueous solution of gelatin and surfactant, which is followed by milling or homogenization of the mixture to disperse the oil phase in the aqueous phase as small droplets. Removable (by washing or evaporation) auxiliary solvents, such as ethyl acetate or cyclohexanone, may also be used in the preparation of such dispersions to facilitate dissolution of the dye in the oil phase.

High-boiling solvents useful for the practice of this invention include aryl phosphates (e.g. tritolyl phosphate), alkyl phosphates (eg. trioctyl phosphate), mixed aryl alkyl phosphates (e.g. diphenyl 2-ethylhexyl phosphate), aryl, alkyl or mixed aryl-alkyl phosphonates, phosphine oxides (e.g. trioctylphosphine oxide), esters of aromatic acids (e.g. dibutyl phthalate, or other phthalates), esters of aliphatic acids (eg. dibutyl sebecate), alcohols (e.g. 2-hexyl-1-decanol), phenols (e.g. p-dodecylphenol), carbonamides (e.g. N,N-dibutyldodecanamide or N-butylacetanalide), sulfoxides (e.g. bis(2-ethylhexyl)sulfoxide), sulfonamides (e.g. N,N-dibutyl-p-toluenesulfonamide) or hydrocarbons (e.g. dodecylbenzene). Additional high-boiling solvents and auxiliary solvents are noted in *Research Disclosure I* (referenced below), December 1989, Item 308119, p 993. High-boiling point phthalates and phosphate solvents are preferred in the present invention. Particularly useful dummy dye:high-boiling solvent weight ratios range from about 1:0.2 to 1:10, with 1:0.4 to 1:5.0 being preferred.

The above described cyan indoaniline dummy dyes may be coated in the photographic elements of this invention either alone in one or more layers or together with other dyes or addenda in the same layer or layers. For example, they may particularly be coated in a layer which does not contain any cyan dye-forming coupler (a coupler being a compound which would produce cyan dye upon reaction with oxidized color developer). In the photographic elements of this invention the cyan indoaniline dyes are preferably coated under at least one of the red-sensitive layers in a multilayer film. By "under", "lower" or similar terms in relation to the position of layers, is meant the layer is further away from a light source during normal exposure of the element. Since the typical photographic element will have a support upon which the photosensitive layers are coated, "under" a red-sensitive layer and the like will mean closer to the support than that red-sensitive layer (while "above" and similar terms will mean further from the support).

It is most common to coat these cyan dummy dyes in a layer adjacent to the transparent film support and under all of the red-sensitive layers of a multilayer film. However, the described indoaniline cyan dummy dyes may also be coated on the side of the support opposite the side on which the light-sensitive emulsion-containing layers are coated. In photographic elements of the present invention, the above described cyan indoaniline dummy dyes may also be coated in one or more of the lower silver halide containing red-sensitive layers of a multilayer film containing more than one red-sensitive layer. Useful coated levels of the cyan indoaniline dummy dyes of this invention typically range from about 0.002g/sq m to 0.20 g/sq m, with coated levels ranging from 0.004 g/sq m to 0.080 g/sq m being preferred ("sq m"=square meter).

To make photographic elements of the present invention, a layer containing a cyan dummy dye of the above described type is formed. Preferably, as described above, at least one red-sensitive layer is preferably formed above the cyan dummy dye containing layer, which red-sensitive layer contains a cyan dye forming coupler which forms a cyan dye upon exposure and processing of the element. In a known manner, further layers or additives may be provided in the photographic element as described herein or which are known.

Examples of nondiffusible indoaniline cyan dummy dyes of formula I of this invention include, but are not limited to, the following (A1–A8):

A1

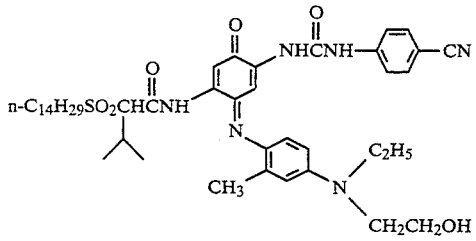

A2

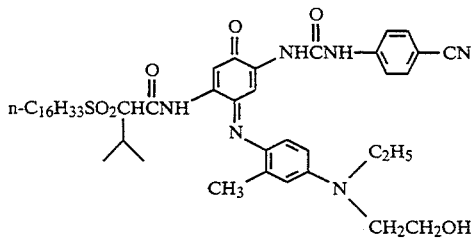

-continued

A3

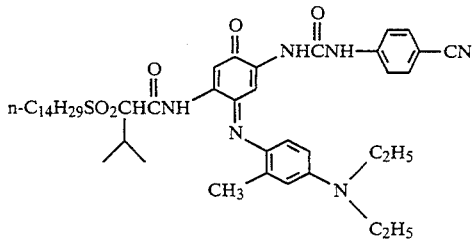

A4

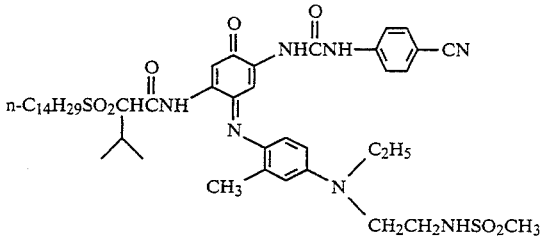

A5

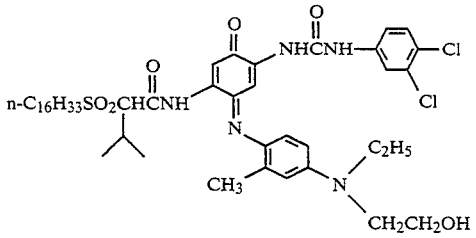

A6

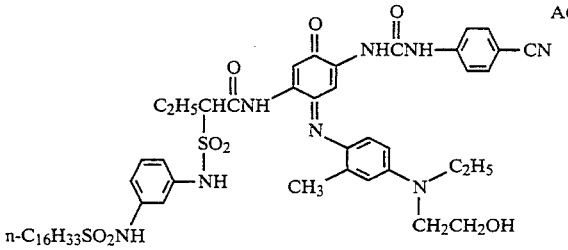

A7

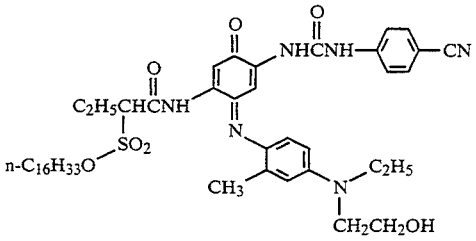

A8

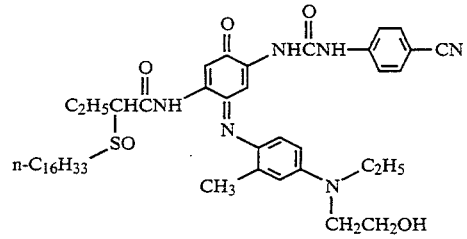

The photographic elements of the present invention can be single color elements or multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, with the reverse order on a reflective support being typical.

In the following discussion of suitable materials for use in elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention can be either negative-working, such as surface-sensitive emulsions or unfogged internal latent image forming emulsions, or direct positive emulsions of the unfogged, internal latent image forming type which are positive working when development is conducted with uniform light exposure or in the presence of a nucleating agent. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described , for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

With negative working silver halide a negative image can be formed. Optionally a positive (or reversal) image can be formed.

The photographic elements of the present may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193,389; EP 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos .4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference. The emulsions and materials to form elements of the present invention, may be coated on pH adjusted support as described in U.S. Pat.

No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred to that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure*, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80°

C., as illustrated in *Research Disclosure*, June 1975, item 13452 and U.S. Pat. No. 3,772,031.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention are preferably imagewise exposed using any of the known techniques, including those described in *Research Disclosure I*, section XVIII. This typically involves exposure to light in the visible region of the spectrum.

Photographic elements comprising the composition of the invention can be processed in any of a number of well-known photographic processes utilizing any of a number of well-known processing compositions, described, for example, in *Research Disclosure I*, or in James, *The Theory of the Photographic Process* 4th, 1977. In the case of processing a reversal color element, the element is first treated with a black and white developer followed by treatment with a color developer. Preferred color developing agents are p-phenylenediamines. Especially preferred are:

4-amino N,N-diethylaniline hydrochloride,
4-amino-3-methyl-N,N-diethylaniline hydrochloride,
4-amino-3-methyl-N-ethyl-N-(β-(methanesulfonamido) ethylaniline sesquisulfate hydrate,
4-amino-3-methyl-N-ethyl-N-(β-hydroxyethyl)aniline sulfate,
4-amino-3-β-(methanesulfonamido)ethyl-N,N-diethylaniline hydrochloride and
4-amino-N-ethyl-N-(2-methoxyethyl)-m-toluidine di-p-toluene sulfonic acid.

Development is followed by bleach-fixing, to remove silver or silver halide, washing and drying.

Synthesis

Many of the above described nondiffusing cyan dummy dyes of formula I used in the photographic elements of the present invention, may be prepared from commonly used developing agents and phenol couplers in a known manner. For example, in the preparation of indoaniline dye (A1) of this invention, coupler S-1 was first prepared according to the procedure described in U.S. Pat. No. 5,045,422. S-1 was then reacted with the developer S-2 to produce dye A1 as shown by the diagram below and described below.

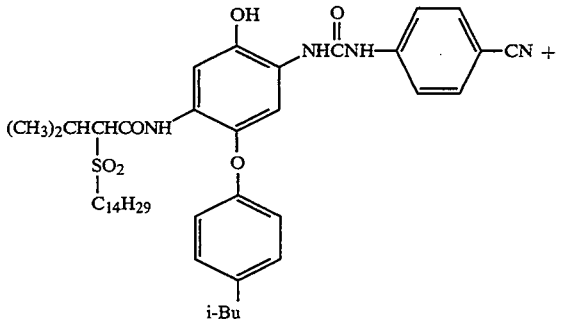

S-1

-continued

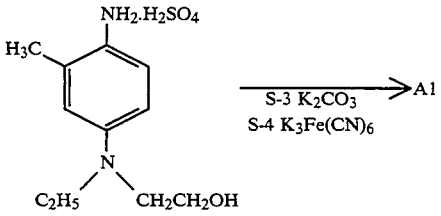

S-2

To an ice-water bath chilled solution of 7.0 g (0.0092 mole) of the coupler (S-1) ("i-Bu" is isobutyl) dissolved in 700 ml ethyl acetate are added in quick succession the following 3 solutions: (1) 3.2 g (0.011 mole) of the color developer (S-2) dissolved in 230 ml water; (2) 7.6 g (0.0552 mole) potassium carbonate dissolved in 230 ml water; and (3) 18.0 g (0.0552 mole) potassium ferricyanide dissolved in 230 ml water. With continued ice-water bath cooling, the heterogeneous reaction mixture is stirred vigorously for 0.5 hr. The ethyl acetate layer that separates after pouring the reaction mixture into a separatory funnel is concentrated to a glass. Purification by passing through silica gel and crystallizing from ethanol yielded 3.4 g of dye (A1) as a dark solid. Identity of product was confirmed by elemental analysis, mass spectrometry and NMR.

The advantages of the indoaniline cyan dummy dyes of this invention and of photographic materials comprising such dyes are illustrated by the following examples. These illustrate that, in comparison to previously known cyan dummy dyes, the photographic elements of the present invention containing the required indoaniline cyan dummy dyes of formula I, show high dye extinction coefficients and reduced density losses in seasoned bleaches, while maintaining the desired hue and resisting density loses on cold storage. High-boiling solvent B1 (referenced below) is di-n-butyl phthalate, B2 is tri-tolyl phosphate (mixed isomers) and B3 is N,N-di-ethyl-n-dodecanamide.

EXAMPLES

In these examples, single-layer dye coatings were prepared and evaluated with respect to dye hue, dye extinction coefficient, resistance to leuco dye formation in a simulated seasoned bleach solution and dye crystallization on cold storage. Dye A1 of this invention was coated with solvents B1 and B2, and dye A3 was coated with B2. Comparative dye C1 was also coated with B1 and with B2, comparative dye C2 (the structures of C1 and C2 are above) was coated with B1 and B2 as well as B3. Comparative dyes C3 and C4 (whose structures are shown below) were coated with high-boiling solvent B2. The dye:solvent weight ratios used in the coated dispersions are indicated in Table I below.

C3

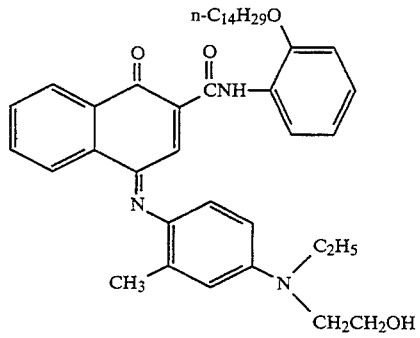

C4

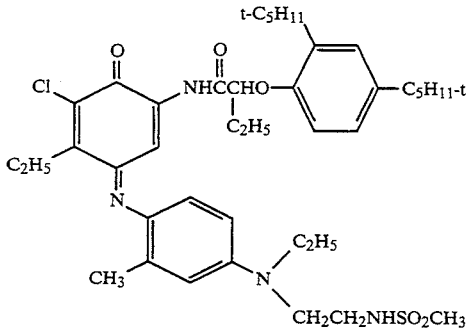

The preparation of the 1:2 dispersion of A1 with B1 is illustrative. To prepare this dispersion, an oil phase consisting of 0.07 g of A1, 0.14 g of B1 and 1.6 ml of ethyl acetate was added to an aqueous phase consisting of 1.0 g of gelatin and 0.1 g of a surfactant (sodium tri-isopropylnaphthalene sulfonate) in 19.9 ml of water. The oil phase was dispersed in the aqueous phase in the form of small particles by passing the mixture through a colloid mill in a manner known in the art. After adding a spreading agent and formaldehyde hardener (0.0075 g) the dispersion was coated at a laydown of 0.10 L/sq m, yielding a dye laydown of about 0.31 g/sq m and a gelatin laydown of about 4.4 g/sq m. The ethyl acetate auxiliary solvent evaporated from the coatings on drying. The coated levels of dye yield densities of about 1.0 at the absorption maximum ("lambda max" or "λmax")

After hardening, the coatings were washed for 5 min at 25° C., dried and the dye absorption spectra were measured on a Sargent-Welch PU8800 spectrophotometer. Dye extinction coefficients (in mmol/cm$^2$) were calculated from the absorbances at lambda max and are provided in Table I along with the lambda max values.

In order to test the propensity for reduction of the cyan dyes to their leuco forms in weak or seasoned bleaches a simple test was designed to simulate the bleach step of photographic process, such as the Eastman Kodak C-41 (a trademark) type process. This test is referenced as the "LCD" test below. After recording the absorption spectra, the dye-containing films were first placed for three minutes in a solution consisting of 50 mL of water, 50 mL of fresh Bleach II used in the C-41 process, 2.0 g of ferrous sulfate heptahydrate, 2.5 g of the dipotassium salt of (ethylenedinitrilo)-tetraacetic acid (EDTA) and 1.5 mL of ammonium hydroxide reagent. The pH of the solution was adjusted to 4.75 with acetic acid prior to immersion of the film samples. This procedure simulates the early stages of the C-41 bleach process, in which ferrous ion concentrations are quite high due to reduction of iron EDTA upon oxidation of developed silver. Then the films samples were placed for four minutes in a solution consisting of 100 mL of fresh C-41 Bleach II, 1.0 g/L of ferrous sulfate heptahydrate and 0.2 g/L of dipotassium EDTA adjusted to a pH of 4.75. This simulates the ferrous ion levels and acidity of seasoned bleaches actually observed in seasoned processing solutions encountered in trade laboratories. The films were then washed and dried, and their spectra were remeasured. The percentage losses in density at lamda max due to leuco cyan dye formation are also listed in Table I.

Dyes similar to those of this invention sometimes show undesirable changes in hue and density, when films containing them are exposed to low temperatures. This is usually due to crystallization of the dyes on cold storage to produce a form with a markedly different absorption spectrum than the dissolved or amorphous forms. To test the tendency for the dyes of this invention to undergo such changes, the film spectra were also measured after storage for 48 hr at −18° C. The percentage density losses at lambda max resulting from cold storage are also listed in Table I.

TABLE I

| | Dye | Solvent (Ratio of Dye/Solvent) | Lambda Max (nm) | Extinction Coefficient (mmol/sq cm) | % Density Loss in Simulated Seasoned Bleach | % Density Loss at Lambda Max 48 hr @ 18° C. |
|---|---|---|---|---|---|---|
| C | C1 | B1 (1:2) | 692 | 20,100 | 34.1 | 0.0 |
| C | C1 | B2 (1:1) | 691 | 29,100 | 29.3 | 0.0 |
| C | C2 | B1 (1:2) | 693 | 29,300 | 0.2 | 0.0 |
| C | C2 | B2 (1:1) | 693 | 25,100 | 0.0 | 0.0 |
| C | C2 | B3 (1:2) | 647 | 21,000 | 0.0 | 0.0 |
| C | C3 | B2 (1:1) | 698 | 24,300 | 4.7 | 69.2 |
| C | C4 | B2 (1:1) | 657 | 26,800 | 16.5 | 0.0 |
| I | A1 | B1 (1:2) | 691 | 41,900 | 0.0 | 0.0 |
| I | A1 | B2 (1:1) | 698 | 31,200 | 0.0 | 0.0 |
| I | A1 | B2 (1:1) | 693 | 32,200 | 0.0 | 0.0 |

C = Comparative Example, I = Invention Example

As is evident from the data in Table I, only the indoaniline cyan dummy dyes of this invention have the proper hue (lambda max about 690–700 nm), have high extinction coefficients (>30,000), have low density losses in a simulated seasoned bleach and show negligible density losses upon cold storage.

In particular, comparative dye C1, while having the proper hue, shows large density losses in the seasoned bleach LCD test and does not have a high extinction coefficient. Comparative dye C3 has the proper hue and improved resistance to leuco dye formation but yields a large density loss on cold storage due to crystallization and also does not have a high extinction coefficient. Comparative dye C4 has a hue that is too hypsochromic, shows a large density loss in the seasoned bleach and does not have a high extinction coefficient. Comparative dye C2 gives a hue that is too hypsochromic in solvent B3 and has a low extinction coefficient in solvents B1, B2 and B3. In solvent B1, dummy dye A1 of this invention has an extinction coefficient that is 43% higher than that of comparative dye C2. This makes it possible to coat much less of A1 than C1 while still obtaining the same density from the dummy dye. With solvent B2, dummy dyes A1 and A2 both have substantially (about 25%) higher extinction coefficients than does comparative dye C2 with B2.

The preceding examples are set forth to illustrate specific embodiments of this invention and are not intended to limit the scope of the compositions or materials of the invention. It will be understood that variations and modifications can be effected within the spirit and scope of the invention.

What is claimed is:

1. A photographic element having a support and a silver halide emulsion layer, the element comprising a cyan dummy dye present in the element prior to exposure and development, the dye having the formula:

I

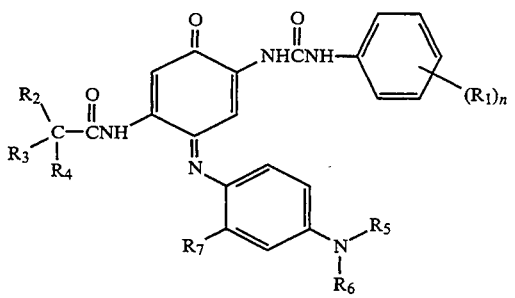

wherein:

n is 1, 2 or 3;

each $R_1$ is an electron-withdrawing group which may be the same or different when n is 2 or 3;

$R_2$ is an alkyl group having from one to 20 carbon atoms, a cycloalkyl group having from 3 to 8 carbon atoms in the ring, or an aryl group;

$R_3$ is an alkyl group having from one to 20 carbon atoms, a cycloalkyl group having from 3 to 8 carbon atoms in the ring, or an aryl group, or is hydrogen;

$R_4$ is selected from the group consisting of alkylsulfonyl, arylsulfonyl, alkylsulfoxyl, arylsulfoxyl, sulfamoyl, alkylsulfonate, carbamoyl, alkoxycarbonyl and acyl groups;

$R_5$ is an alkyl group;

$R_6$ is hydrogen, or an alkyl group, and $R_7$ is hydrogen or an alkyl group.

2. A photographic element according to claim 1 wherein $R_2$, $R_3$ and $R_4$ combined have at least 10 carbon atoms.

3. A photographic element according to claim 2 wherein $R_5$ is ethyl, and $R_6$ is ethyl, beta-hydroxyethyl, or beta-methylsulfonamido)ethyl and $R_7$ is methyl.

4. A photographic element having a support and a silver halide emulsion layer, the element comprising a cyan dummy dye present in the element prior to exposure and development, the dye having the formula: wherein:

I

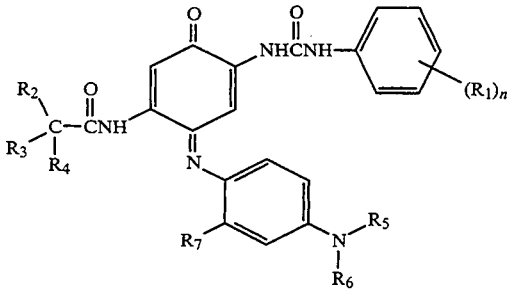

n is 1, 2 or 3;

each $R_1$ is an electron-withdrawing group which may be the same or different when n is 2 or 3;

$R_2$ is an alkyl group having from one to 20 carbon atoms, a cycloalkyl group having from 3 to 8 carbon atoms in the ring, or an aryl group;

$R_3$ is an alkyl group having from one to 20 carbon atoms, a cycloalkyl group having from 3 to 8 carbon atoms in the ring, or an aryl group, or is hydrogen;

$R_4$ is an alkylsulfonyl group;

$R_5$ is an alkyl group;

$R_6$ is hydrogen, or an alkyl group, and $R_7$ is hydrogen, or an alkyl group.

5. A photographic element according to claim 4 wherein $R_2$, $R_3$ and $R_4$ combined have at least 10 carbon atoms.

6. A photographic element according to claim 4 additionally comprising a layer which does not contain any cyan dye-forming coupler, wherein the cyan dummy dye is present in the layer which does not contain any cyan dye-forming coupler.

7. A photographic element according to claim 4 additionally comprising at least one red-sensitive silver halide layer, wherein the cyan dummy dye is present beneath at least one red-sensitive silver halide layer.

8. A photographic element according to claim 7 wherein the cyan dummy dye is present in a layer beneath all red-sensitive silver halide layers.

9. A photographic element according to claim 4 wherein the cyan dummy dye is present in the element in an amount of 0.002 $g/m^2$ to 0.20 $g/m^2$.

10. A photographic element comprising a red-sensitive layer containing a red-sensitive silver halide emulsion and a cyan dye forming coupler which forms a cyan dye upon exposure and processing of the element, and comprising a second layer below the red-sensitive layer which second layer contains a cyan dummy dye present in the element prior to exposure and development, the dye having the formula:

wherein:

I

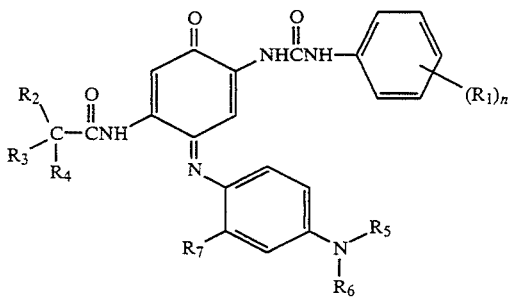

n is 1, 2 or 3;

each $R_1$ is an electron-withdrawing group which may be the same or different when n is 2 or 3;

$R_2$ is an alkyl group having from one to 20 carbon atoms, a cycloalkyl group having from 3 to 8 carbon atoms in the ring, or an aryl group;

$R_3$ is an alkyl group having from one to 20 carbon atoms, a cycloalkyl group having from 3 to 8 carbon atoms in the ring, or an aryl group, or is hydrogen;

$R_4$ is selected from the group consisting of alkylsulfonyl, arylsulfonyl, alkylsulfoxyl, arylsulfoxyl, sulfamoyl, alkylsulfonate, carbamoyl, alkoxycarbonyl and acyl groups;

$R_5$ is an alkyl group;

$R_6$ is hydrogen, or an alkyl group; and $R_7$ is hydrogen or any alkyl group.

11. A photographic element according to claim 10 additionally comprising a green-sensitive layer containing a green-sensitive silver halide emulsion and a magenta dye forming coupler which forms a magenta dye upon exposure and processing of the element, and comprising a blue-sensitive layer containing a blue-sensitive silver halide emulsion and a yellow dye forming coupler which forms a yellow dye upon exposure and processing of the element.

12. A photographic element according to claim 10 wherein the cyan dummy dye is present in the element in an amount of 0.002 $g/m^2$ to 0.20 $g/m^2$.

13. A photographic element according to claim 10 wherein the cyan dummy dye is present in the element in an amount of 0.004 $g/m^2$ to 0.080 $g/m^2$.

14. A photographic element according to claim 11 wherein $R_2$, $R_3$ and $R_4$ combined have at least 10 carbon atoms.

15. A photographic element according to claim 11 wherein $R_5$ is ethyl, and $R_6$ is ethyl, beta-hydroxyethyl, or beta-(methylsulfonamido)ethyl and $R_7$ is methyl.

16. A photographic element according to claim 10 wherein the cyan dummy dye is provided in the second layer in the form of dispersion of a high-boiling solvent containing the dummy dye.

17. A photographic element according to claim 16 wherein the dummy dye:high boiling point solvent ratio is from 1:0.2 to 1:10.

18. A photographic element according to claim 17 wherein the high boiling point solvent is a phthalate or phosphate solvent.

19. A method of making a photographic element comprising forming a layer containing a cyan dummy dye, the dye having the formula:

I

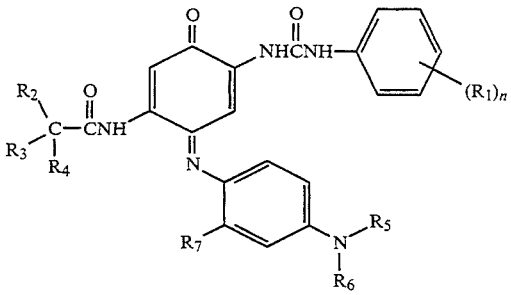

wherein:

n is 1, 2 or 3;

each $R_1$ is an electron-withdrawing group which may be the same or different when n is 2 or 3;

$R_2$ is an alkyl group having from one to 20 carbon atoms, a cycloalkyl group having from 3 to 8 carbon atoms in the ring, or an aryl group;

$R_3$ is an alkyl group having from one to 20 carbon atoms, a cycloalkyl group having from 3 to 8 carbon atoms in the ring, or an aryl group, or is hydrogen;

$R_4$ is selected from the group consisting of alkylsulfonyl, arylsulfonyl, alkylsulfoxyl, arylsulfoxyl, sulfamoyl, alkylsulfonate, carbamoyl, alkoxycarbonyl and acyl groups;

$R_5$ is an alkyl group;

$R_6$ is hydrogen, or an alkyl group; and $R_7$ is hydrogen or an alkyl group; and forming a red-sensitive silver halide emulsion layer above the cyan dummy dye containing layer.

20. A method according to claim 19 wherein the red-sensitive layer contains a cayn dye forming coupler which forms a cyan dye upon exposure and processing of the element.

* * * * *